US006272777B1

(12) United States Patent
Swenson

(10) Patent No.: US 6,272,777 B1
(45) Date of Patent: Aug. 14, 2001

(54) PACKAGING SYSTEM FOR CLEAR BOTTLED LIQUIDS

(76) Inventor: Chester A. Swenson, 22733 Ticonderoga Rd., Calabasas, CA (US) 91302

( * ) Notice: Subject to any disclaimer, the term of this patent is extended or adjusted under 35 U.S.C. 154(b) by 0 days.

(21) Appl. No.: 09/347,075

(22) Filed: Jul. 2, 1999

(51) Int. Cl.[7] ..... G09F 3/00
(52) U.S. Cl. ..... 40/310; 215/365; 283/81
(58) Field of Search ..... 40/310; 215/365, 215/366; 283/81, 117

(56) References Cited

U.S. PATENT DOCUMENTS 426,342 * 4/1890 Wallace, Jr. ..... 40/310
492,641 * 2/1893 Tibbals ..... 40/310
635,098 * 10/1899 Henckel ..... 40/310
2,158,633 * 5/1939 Normandi et al. ..... 283/81 X
2,810,978 * 10/1957 Chapman ..... 40/310
4,115,939 * 9/1978 Marks ..... 40/310
5,758,440 * 6/1998 Yudin ..... 40/310

* cited by examiner

*Primary Examiner*—Brian K. Green
(74) *Attorney, Agent, or Firm*—Kelly Bauersefeld Lowry & Kelley, LLP

(57) ABSTRACT

A packaging system for bottled liquids includes a transparent bottle filled with clear liquid allowing a first surface to be viewable through an opposite second arcuate surface. A first label having indicia on a first side is attached to the first surface such that the indicia is substantially magnified when viewed through the second arcuate surface of the bottle.

17 Claims, 1 Drawing Sheet

PACKAGING SYSTEM FOR CLEAR BOTTLED LIQUIDS

BACKGROUND OF THE INVENTION

The present invention relates to packaging for clear bottled liquids. More particularly, the present invention relates to a packaging system which utilizes the curvature of the bottle to magnify indicia on a side of a label adhered to the bottle.

Bottles are manufactured in a number of varieties of shapes, sizes and colors. This is particularly true with bottles which are produced for alcoholic beverages. Some companies utilize a particular shape, size or color of bottle so that the consumer can readily differentiate their product from other similar products.

Aside from the differences in the bottles themselves, manufacturers and distributors also attach labels or print directly onto the bottles in order to advertise the contents of the bottle, the source of the contents, ingredients and so forth. It is not uncommon for dozens of varieties of bottles to be placed next to one another on shelving in the store. In order to appeal to and catch the attention of the customer, the printing and labels are often quite elaborate and/or colorful. This can significantly add to the cost of producing the bottle and packaging.

Although the printing is intended to be viewed from an outer surface, customers can also view the printing through the bottle on the opposing surface of clear bottles containing a transparent or semi-transparent liquid. However, the print is transposed which makes symbols appear differently than they normally would.

Some companies have frosted or otherwise made opaque areas of the bottle so as to hide portions of the printing on an opposite side of the bottle. Other companies have applied opaque labels on one or both sides of the bottle to hide the printing on the backside of the bottle or label. The idea behind such labeling techniques is not to distract the consumer or render the front side of the packaging cluttered or illegible due to the printing and labeling which is viewable through the front side. However, an opaque label on the back side is oftentimes also visible from the front side and is visually unattractive.

Some have recognized that the side of a label adhered to a bottle can be advantageously utilized to convey information to the consumer. At least one company prints pictorial images on the adhered side of the back label so as to be viewable through the front of a bottle having planar front and rear surfaces. The company uses a combination of the front and back images to convey the source of the bottle and at least some of the pertinent information regarding the content of the bottle. However, the use of a square bottle having flat surfaces does not enlarge or otherwise enhance the image.

What is needed, therefore, is a packaging system which is used on clear bottles containing a transparent or semi-transparent liquid and having arcuate surfaces which provides information and symbols not only on the outer faces of the labels, but also the inner adhered faces of the label so as to be seen through the bottle and magnified by the bottle to give the bottle a distinctive and recognizable appearance. The present invention fulfills this need and provides other related advantages.

SUMMARY OF THE INVENTION

The present invention resides in a packaging system for bottled liquids comprising a transparent bottle filled with a clear liquid which allows a first surface to be viewable through an opposite second arcuate surface. A first label having indicia on a first side is attached to the first surface such that the indicia is substantially magnified when viewed through the second surface of the bottle. The first label typically includes indicia on a second side thereof also.

The system may also include a second label having a first side with indicia thereon and which is attached to the second surface of the bottle such that the indicia is substantially magnified when viewed through the first surface of the bottle. The second label may also have indicia on a second side thereof.

The first surface of the bottle can also be arcuate as with generally cylindrical or spherical bottles. The liquid can be transparent or semi-transparent so long as the indicia is visible through the bottle.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
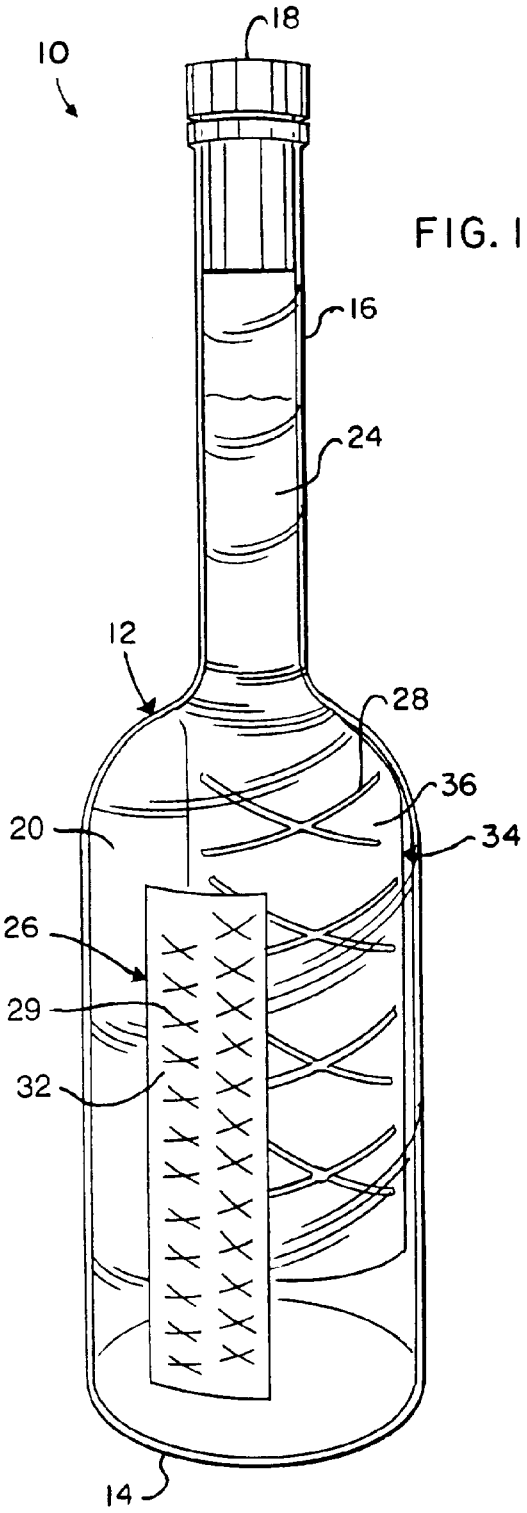
FIG. 1 is a perspective view of a generally cylindrical bottle having first and second labels on opposing arcuate surfaces of the bottle, each label having indicia on first and second sides thereof, wherein the indicia on the attached first side of the second label is substantially magnified when viewed through the bottle.

As shown in the drawings for purposes of illustration, the present invention is concerned with a packaging system for clear bottled liquids, generally referred to by the reference number 10.

In the exemplary embodiment, the packaging system 10 includes a clear bottle 12 having a flat base 14, an elongated neck 16 having a stopper 18 at an open end thereof, and a generally cylindrical wall having opposing first and second surfaces 20 and 22 which are substantially arcuate in shape. The bottle 12 contains a clear (transparent or semi-transparent) liquid 24. Although the bottle is typically comprised of glass, it will be appreciated that the bottle 12 can be comprised of any clear material which is suitable for storing the liquid 24.

A first label 26 has indicia 28 on a first side 30 (represented by single cross-checks) and indicia 29 on a second side 32 (represented by double cross-checks) thereof. The indicia 28 and 29 may include words, symbols and/or pictures. The first side 30 of the first label 26 is adhered or otherwise securely attached to the first surface 20 of the bottle 12 so that the indicia 29 on the second side 32 is visible and undistorted from the perspective of the first surface 20 of the bottle 12, as illustrated in FIG. 1.

Figure 2:
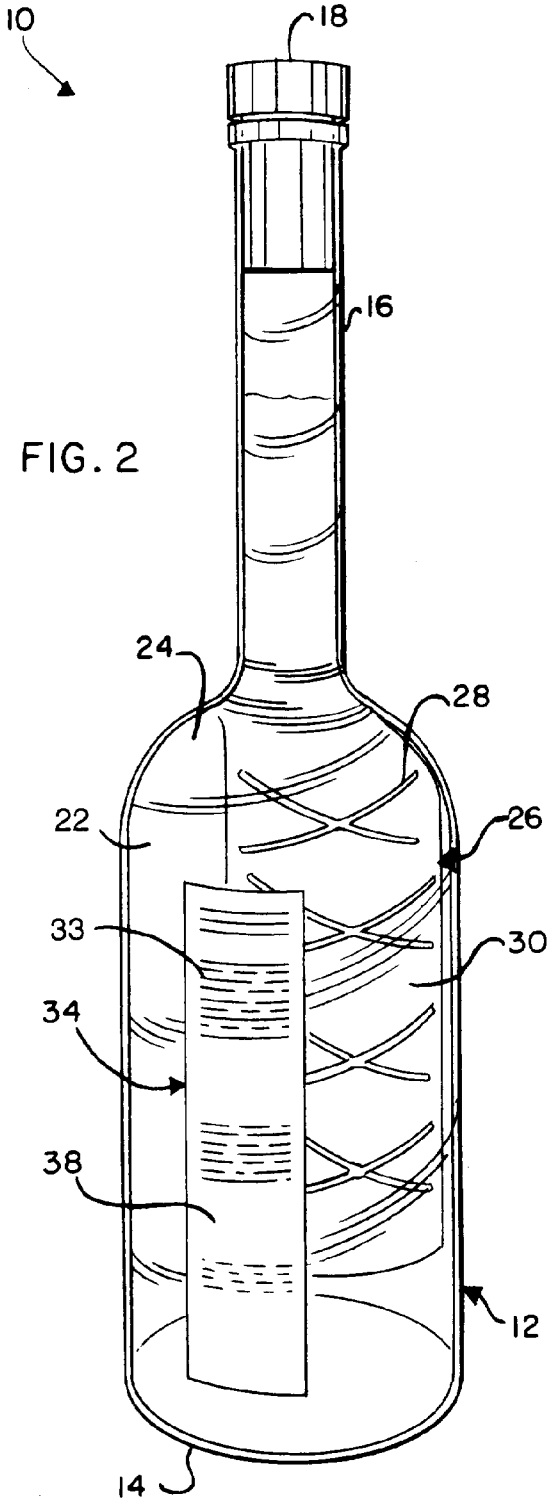
FIG. 2 is another perspective view of the bottle of FIG. 1, illustrating the indicia on the adhered first side of the first label also magnified when viewed through the bottle.

Similarly, a second label 34 has indicia 28 on both a first side 36 (represented by single cross-checks) and second side 38 represented by horizontal lines) thereof. The first side 36 of the second label 34 is attached to the second surface 22 of the bottle 12 so that the indicia 28 of the second side 38 is visible and undistorted from the perspective of the second surface 22 of the bottle 12, as illustrated in FIG. 2. As illustrated in the drawings, the labels 26 and 34 are preferably of substantially identical size.

When viewing the bottle 12 from the first surface 20, the indicia 28 of the second side 32 of the first label 26 is clearly visible and undistorted. Through the liquid 24, the indicia 28 of the first side 36 of the second label 34 is viewable and magnified by the curvature of the first surface 20 and the liquid 24 within the bottle 12. If the first and second labels 26 and 34 are positioned on opposing surfaces of the bottle 12, the indicia 28 of the second side 32 of the first label 26 is superimposed upon the magnified indicia 28 of the first side 36 of the second label 34 as shown in FIG. 1. Likewise, when viewing the indicia 28 of the second side 38 of the second label 34 from the second surface 22 of the bottle 12, the indicia 28 of the second side 38 is superimposed upon the magnified indicia 28 of the first side 30 of the first label 26 as shown in FIG. 2.

It will be understood that the invention embraces the concept of a single label having indicia on only the attached side, together with a bottle that magnifies that indicia. In order to achieve the desired magnification, bottles having substantially arcuate surfaces such as cylindrical or spherical bottles are used as the entire outer surface of these bottles is curved. However, other bottle configurations having only a portion of the outer surface arcuate can be used in the packaging system 10 as well. Although the packaging system can be used for a variety of bottled liquid goods, the invention is particularly useful in clear liquor bottles having transparent or semi-transparent liquid, such as vodka.

Although one embodiment has been described in detail for purposes of illustration, various modifications may be made without departing from the scope and spirit of the invention. Accordingly, the invention is not to be limited, except as by the appended claims.

What is claimed is:

1. A packaging system for bottled liquids, comprising:

a transparent bottle filled with a clear liquid, the bottle including a first surface and an opposite arcuate second surface;

a first label having a first side attached to the first surface and including indicia on the first side; and a second label having a first side attached to the second surface of the bottle and a second side having indicia thereon;

wherein the first and second labels are of substantially identical size and are directly positioned opposite one another on the bottle such that when viewing the indicia on the second side of the second label on the second surface of the bottle the indicia on the first side of the first label is substantially magnified and the second label is superimposed upon and at least partially surrounded by the magnified indicia of the first side of the first label.

2. The packaging system of claim 1, wherein the first surface is arcuate.

3. The packaging system of claim 2, wherein the bottle is generally cylindrical.

4. The packaging system of claim 2, wherein the second label includes indicia on the first side thereof which is substantially magnified and the first label is superimposed upon and at least partially surrounded by the magnified indicia of the first side of the second label when viewing a second side of the first label on the first surface of the bottle.

5. The packaging system of claim 4, wherein when the indicia on the second side of the first label is viewed from the first surface of the bottle, the indicia on the first side of the second label is substantially magnified and the first label is superimposed upon and at least partially surrounded by the magnified indicia of the first side of the second label.

6. The packaging system of claim 1, wherein the liquid is transparent.

7. The packaging system of claim 1, wherein the liquid is semi-transparent.

8. The packaging system of claim 1, wherein the first label includes indicia on a second side thereof.

9. The packaging system of claim 1, wherein when the indicia on the second side of the second label is viewed from the second surface of the bottle, the indicia on the first side of the first label substantially magnified and the second label is superimposed upon and at least partially surrounded by the magnified indicia of the first side of the first label.

10. A packaging system for bottled liquids, comprising:

a transparent bottle filled with a clear liquid, the bottle including an arcuate first surface and an opposite arcuate second surface;

a first label having a first side attached to the first surface and having indicia on the first side thereof; and a second label having a first side attached to the second surface and having indicia on the first side thereof;

wherein the first and second labels are of substantially identical size and positioned directly opposite one another such that when the second label is viewed from the second surface of the bottle the second label is superimposed upon and at least partially surrounded by the magnified indicia of the first side of the first label, and the indicia on the first side of the second label is magnified when the first label is viewed from the first surface of the bottle such that the first label is superimposed upon and at least partially surrounded by the magnified indicia of the first side of the second label.

11. The packaging system of claim 10, wherein the first label includes indicia on a second side thereof.

12. The packaging system of claim 10, wherein the second label includes indicia on a second side thereof.

13. The packaging system of claim 10, wherein the bottle is generally cylindrical.

14. The packaging system of claim 10, wherein the liquid is transparent.

15. The packaging system of claim 10, wherein the liquid is semi-transparent.

16. The packaging system of claim 10, wherein when the indicia on the second side of the second label is viewed from the second surface of the bottle, the indicia on the first side of the first label substantially magnified and the second label superimposed upon and at least partially surrounded by the magnified indicia of the first side of the first label, and when the indicia on the second side of the first label is viewed from the first surface of the bottle, the indicia on the first side of the second label is substantially magnified and the first label is superimposed upon at least partially surrounded by the magnified indicia of the first side of the second label.

17. A packaging system for bottled liquids, comprising:

a transparent, generally cylindrical bottle filled with a transparent liquid, the bottle including an arcuate first surface and an opposite arcuate second surface;

a first label having a first side attached to the first surface and indicia on first and second sides thereof; and a second label having a first side attached to the second surface and indicia on first and second sides thereof;

wherein the first and second labels are of substantially identical size and positioned directly opposite one another such that when the indicia on the second side of the second label is viewed from the second surface of the bottle, the indicia on the first side of the first label is substantially magnified and the second label is superimposed upon and at least partially surrounded by the magnified indicia of the first side of the first label; and wherein when the indicia on the second side of the first label is viewed from the first surface of the bottle, the indicia on the first side of the second label is substantially magnified and the first label is superimposed upon and at least partially surrounded by the magnified indicia of the first side of the second label.

* * * * *